US006450792B1

(12) United States Patent
Eisenbacher et al.

(10) Patent No.: US 6,450,792 B1
(45) Date of Patent: Sep. 17, 2002

(54) HYDRAULIC DISPLACEMENT MACHINE

(75) Inventors: Egon Eisenbacher, Karlstadt; Christoph Renner, Partenstein, both of (DE)

(73) Assignee: Hydraulik-Ring GmbH, Limbach-Oberfrohna (DE)

( * ) Notice: Subject to any disclaimer, the term of this patent is extended or adjusted under 35 U.S.C. 154(b) by 0 days.

(21) Appl. No.: 09/468,482

(22) Filed: Dec. 17, 1999

(30) Foreign Application Priority Data

Dec. 18, 1998 (DE) ..... 198 58 483

(51) Int. Cl.[7] ..... F01C 1/10
(52) U.S. Cl. ..... 418/170; 92/72; 92/129
(58) Field of Search ..... 92/72, 129, 140, 92/172, 222; 418/170, 126

(56) References Cited

U.S. PATENT DOCUMENTS

| | | | | |
|---|---|---|---|---|
| 3,808,659 A | | 5/1974 | Alger, Jr. et al. | |
| 4,132,515 A | * | 1/1979 | Kruger | 418/170 |
| 4,501,613 A | * | 2/1985 | Matsumoto | 75/240 |
| 5,082,433 A | * | 1/1992 | Leithner | 419/11 |
| 5,572,922 A | * | 11/1996 | Moon | 92/181 P |
| 5,749,331 A | * | 5/1998 | Pettersson et al. | 123/193.2 |

FOREIGN PATENT DOCUMENTS

| | | | |
|---|---|---|---|
| DE | 2010659 | | 9/1970 |
| DE | 1934467 | | 2/1971 |
| DE | 2254752 | | 5/1974 |
| DE | 4021500 | A1 | 1/1992 |
| DE | 4200987 | A1 | 7/1993 |
| DE | 4213798 | A1 | 10/1993 |
| DE | 4322240 | C2 | 1/1995 |
| DE | 4430909 | A1 | 3/1996 |
| DE | 19528618 | A1 | 2/1997 |
| DE | 19725195 | A1 | 1/1998 |
| DE | 19726794 | A1 | 1/1999 |
| EP | 0116136 | | 8/1984 |
| JP | 05051709 | | 3/1993 |
| JP | 06207252 | | 7/1994 |
| JP | 08159044 | | 6/1996 |

* cited by examiner

*Primary Examiner*—F. Daniel Lopez
*Assistant Examiner*—Thomas E. Lazo
(74) *Attorney, Agent, or Firm*—Gudrun E. Huckett

(57) ABSTRACT

The invention relates to a displacement machine, in particular a displacement pump used in an automobile and having two components movable slidably relative to one another.

In order to keep the wear on the components low, even in the case of a poorly lubricating operating medium, there is provision for at least one component of the two components to be hardened at least on the surface and to consist of sintered material which contains predominantly ferrite and a constituent for improving the sliding properties.

This design is particularly advantageous in automobile pumps operating with transmission oil or feeding fuel.

16 Claims, 3 Drawing Sheets

HYDRAULIC DISPLACEMENT MACHINE

BACKGROUND OF THE INVENTION

The invention proceeds from a hydraulic displacement machine, in particular from a displacement pump, which has two components slidably movable relative to one another.

A displacement of this type, designed as an internal gear pump, is shown, for example, in DE 43 22 240 C2. In this known internal gear pump, the pinion and ring wheel enclose a crescent-shaped pump chamber, in which is located an approximately semicrescent-shaped filling piece, by means of which the high-pressure region and the low-pressure region of the pump are sealed off relative to one another along the tooth tips of the two gearwheels. For efficient sealing off, even in the event of pronounced pressure differences between the high-pressure region and the low-pressure region, the filling piece is divided longitudinally. The gap between the two filling piece parts is subjected to pressure in such a way that the two filling piece parts are in each case pressed with a slight excess of force against the tooth tips of the gearwheels.

The high-pressure region and low-pressure region of a gear machine must also be sealed off relative to one another on the end faces of the gearwheels. If the gear machine is also to be used at higher pressures and is to seal off with high efficiency, components are also used for sealing off on the end faces of the gearwheels, said components being pressed with some excess of force against the gearwheels. For this purpose, a pressure field is connected to the high-pressure region of the gear machine on the rear side, facing away from the gearwheels, of the components, which are usually designated as axial sealing disks.

The materials hitherto used for the components pressed against the gearwheels for sealing-off purposes undergo abrasive wear, particularly at high rotational speeds of the internal gear machine and when the working medium is at high pressure and at high temperatures. To be precise, the excess of force with which the components are pressed against the gearwheels is obtained essentially by means of surfaces of different size, on which the pressure acts, and therefore increases with a rising pressure. High rotational speeds and high temperatures may lead to faulty lubrication between the components and the gearwheels. The abrasion enters the hydraulic circuit and may cause damage and malfunctions.

It is possible, in principle, to remove the abrasion from the hydraulic medium by the installation of a filter. Systems where so-called stationary hydraulics operate are equipped, so to speak, as standard, with a filter. There are, however, also applications, particularly in the automotive sector, where the use of filters is to be avoided. Filters of this type gradually become clogged, consequently increase the pressure losses in the hydraulic circuit and have to be exchanged. A part is played, last but not least, by the space which would be necessary for a filter and access to it and by the additional costs of manufacturing automobiles.

Moreover, wear on the components sliding against one another cannot always be compensated by a type of adjustment, so that the internal leakages in the machine increase and efficiency losses increase.

Problems with the wear of components sliding against one another in a displacement machine arise, irrespective of specific operating parameters, such as high rotational speed or high temperature, even when the operating medium has per se poor lubricating properties. Operating media of this type are, for example, fuels, such as gasoline or diesel for internal combustion engines. Piston pumps, in particular radial piston pumps, are predominantly used for the high-pressure feed of fuels of this type.

A displacement machine of the generic type, designed as a radial piston pump and provided for the high-pressure feed of fuel, is known, for example, from DE 42 13 798 A1. In such a radial piston pump, on the one hand, the piston and cylinder, as displacement parts, slide against one another. On the other hand, one of the two displacement parts or a sliding shoe held on it slides on an eccentric ring, by means of the which the movement of the one displacement part is brought about in the feed stroke.

SUMMARY OF THE INVENTION

The object on which the invention is based is, therefore, to develop further a hydraulic displacement machine, which overcomes the above-mentioned disadvantages of the prior art devices of this general type, in such a way that the wear on the components sliding against one another is low. In particular, when the gear pump is used in an automobile, here particularly in the region of the gear, wear-induced particles are to be discharged into the hydraulic medium only to a very slight extent and the installation of a filter or at least the exchange of a filter is to be capable of being dispensed with. When a piston pump is used for feeding fuel, the wear on the components sliding against one another is to be low, despite the poor lubricating capacity of the operating medium, so that abrasion particles do not block the injection nozzles or make them sluggish and so that a failure of the pump due to the seizure of the displacement parts or due to excessive wear on the lifting element is avoided.

In a displacement machine of the aforementioned type object is achieved, according to the invention, in that at least one of the two components is hardened at least on the surface and consists of sintered material which contains predominantly ferrite and, in addition, a constituent for improving the sliding properties. The mixing of hardenable ferrite for component strength and wear resistance with a constituent for improving the sliding properties gives rise, after sintering, hardening and a grinding process, by means of which the component acquires its exact dimensions and a smooth surface, to a component which tolerates even faulty lubrication during operation without any appreciable abrasion. As a result, the wear on the displacement machine and the discharge of particles by the latter are very low.

Pursuant to one specific embodiment of the present invention, in an internal gear machine, preferably one component is produced from sintered material which serves for sealing off a high-pressure region from a low-pressure region along the tooth tips or along the end faces of the gearwheels.

In a hydraulic piston machine, it is beneficial if, at least one of the two displacement parts of a displacement unit, specifically piston and cylinder, is produced from the sintered material hardened at least on the surface. Advantageously, at least part of the displacement part/lifting element pair is also produced from the sintered material. In this case, it should be pointed out expressly that one displacement part or the lifting element may also be of multipart design, and only one of these parts, specifically that part sliding on the counterpiece, consists of sintered material.

Preferably, the component consisting of the sintered material is hardened by nitriding, an edge zone of the component being enriched with nitrogen at temperatures of around 500 degrees Celsius, by the component being exposed to a nitrogen-discharging medium, for example a gas stream.

Nitriding per se is a generally known method for the surface-hardening of components, so that there is no need to discuss it in any more detail here.

The component contains as constituents improving the sliding properties, preferably copper, molybdenum disulfide and graphite. The requirements are satisfied particularly effectively by a combination of these constituents with one another in the proportions specified as preferred.

BRIEF DESCRIPTION OF THE DRAWINGS

A first exemplary embodiment, designed as an internal gear pump, and a second exemplary embodiment, designed as a radial piston pump, of a hydraulic displacement machine according to the invention are illustrated in the drawing. The invention, then, is explained in more detail by means of the figures of this drawing in which.

DESCRIPTION OF PREFERRED EMBODIMENTS

Figure 1:
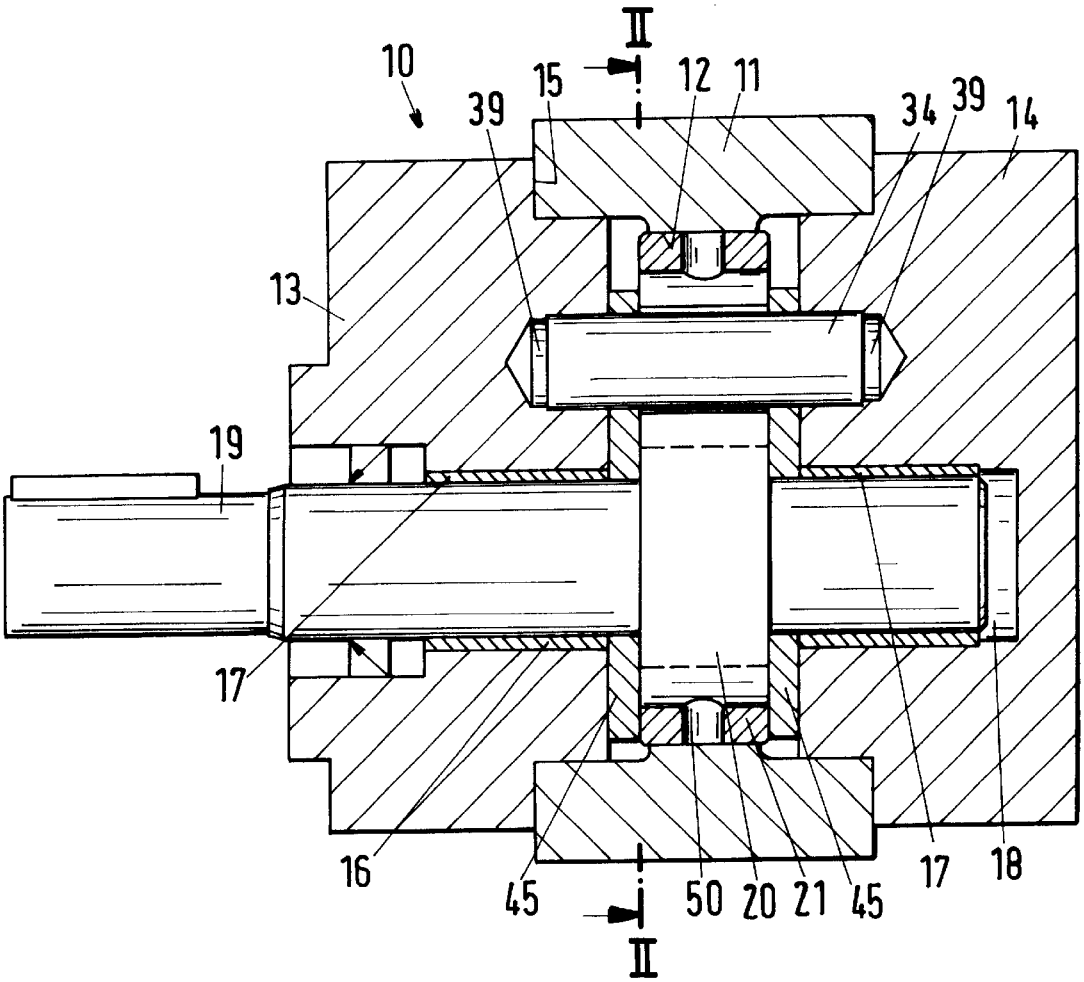
FIG. 1 shows the first exemplary embodiment in a section through the plane spanned by the two axes of the gearwheels.
Figure 2:
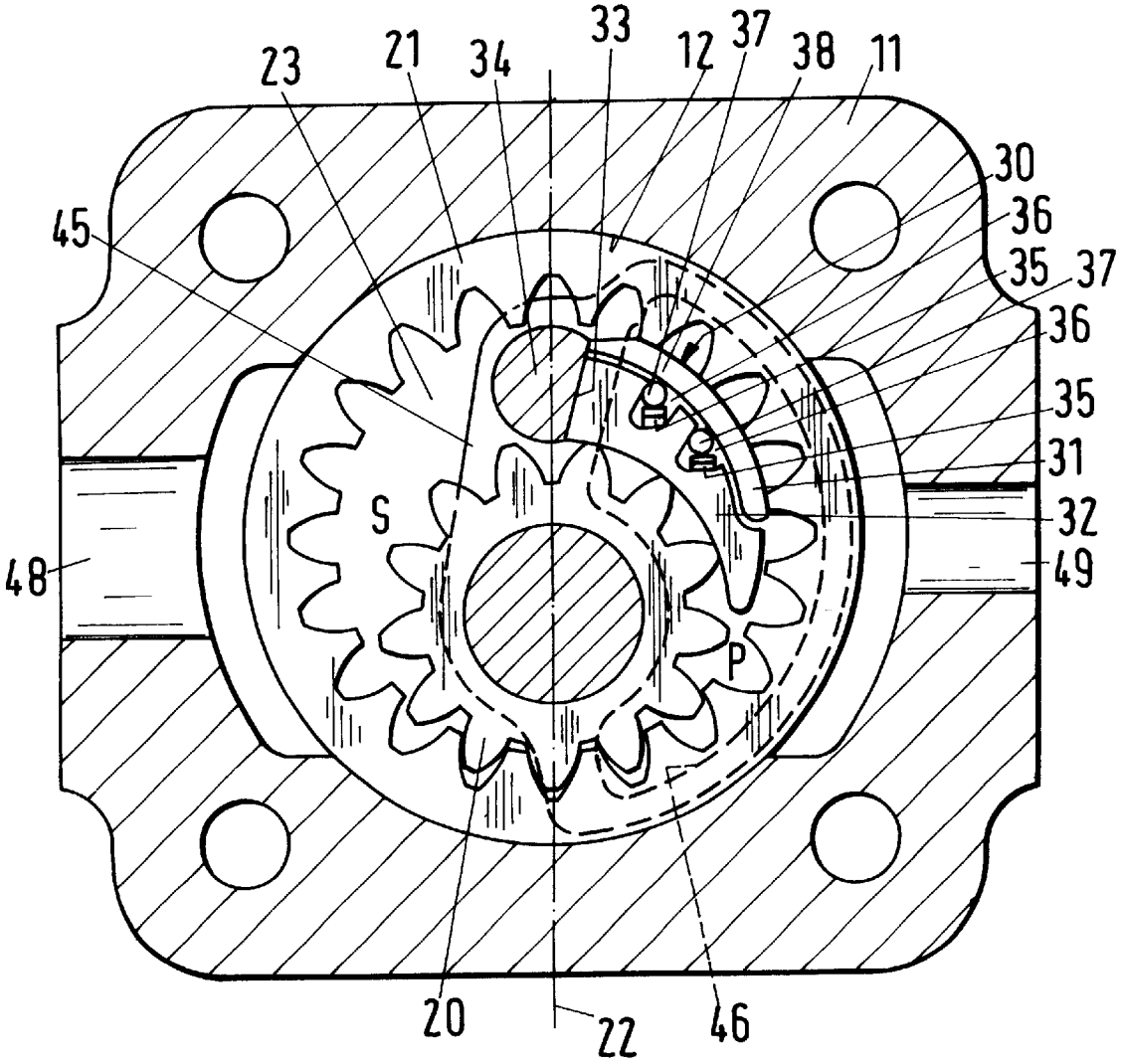
FIG. 2 shows a section along the line II—II from FIG. 1.

The internal gear pump according to FIGS. 1 and 2 possesses a casing 10 which is composed of an annular middle part 11, which radially encloses a pump chamber 12, a first cover part 13 and a second cover part 14. The two cover parts 13 and 14 delimit the pump chamber 12 in the axial direction. The middle part 11 engages over the two cover parts 13 and 14 in the region of an outer lathe-turned recess 15 in each case. The cover part 13 possesses a continuous bore 16, into which a sliding bearing 17 is pressed. A blind bore 18 of the cover part 14 is in alignment with the bore 16, a sliding bearing 17 likewise being pressed into said blind bore. A drive shaft 19 of the pump is mounted in the two sliding bearings 17. An externally toothed pinion 20 is fastened, within the pump chamber 12, to the drive shaft 19 or is produced in one piece with the latter. The pinion is located within an internally toothed ring wheel 21, the axis of which is arranged eccentrically to the axis of the pinion 20 and which, on its outer circumference, is mounted in the middle part 11 of the casing 10. In the region on both sides of a mid-plane 22 spanned by the two axes of the pinion 20 and of the ring wheel 21, the two gearwheels mesh with one another, a crescent-shaped free space 23 moreover being located between these.

About half of this free space 23 is filled by a filling piece 30. For the pump to have high efficiency, good sealing off is necessary between the filling piece 30 and the toothed rims of the pinion and ring wheel. The filling piece 30 is therefore composed in two parts of a sealing segment 31 and of a segment carrier 32. The sealing segment 31 is adjacent to the ring wheel 21 and can be pressed with a slight excess of force against the tooth tips of the ring wheel 21. Moreover, when the pump is in operation, the sealing segment 31 is also pressed hydraulically against a flattening 33 of a stop pin 34. During operation, the segment carrier 32 is pressed hydraulically with an inner face and with an excess of force against the toothed rim of the pinion 20 and likewise against the flattening 33 of the stop pin 34.

The segment carrier 32 and the sealing segment 31 are pressed apart from one another by two leaf springs 35 located in two grooves 36 of the segment carrier 32 which run axially and which are open toward the sealing segment 31. The two grooves 36 each receive, in addition to a leaf spring 35, a sealing roller 37 which is pressed by the respective leaf spring 35, but, during operation, also hydraulically, onto the gap between the segment carrier 32 and the sealing segment 31. By means of the two sealing rollers 37, a pressure space sealed off relative to the high-pressure region P and relative to the low-pressure region S of the pump is obtained within the gap existing between the segment carrier 32 and the sealing segment 31, the intention being to subject said pressure space to a pressure which corresponds approximately to half the operating pressure of the pump. Said pressure space is therefore connected, in each case via a milled recess 38 in each end face of the sealing segment, to a pressure build-up region on the toothed rim of the ring wheel 21, approximately half the operating pressure prevailing in said region. During operation, therefore, the segment carrier 32 and the sealing segment 31 are pressed apart from one another not only by the leaf springs 35, but also, in the region upstream of the sealing roller 37 nearest to the stop pin 34, by a hydraulic pressure. This pressure corresponds, between the two sealing rollers 37, to a fraction of the operating pressure, whereas, between that end of the sealing segment 32 which is remote from the stop pin 34 and said sealing roller 37, this pressure is identical to the operating pressure.

The stop pin 34 passes through the free space 23 in the mid-plane 22 and is mounted rotatably, on both sides of the pump chamber 12, in two mutually aligned blind bores 39 of the cover parts 13 and 14. The axial extent of the filling piece 30 is identical to the axial extent of the two gearwheels 20 and 21.

For the pump to have high efficiency, it is necessary also on the end faces of the gearwheels 20 and 21, that is to say axially, to have good sealing off between the high-pressure side P, which can be delimited by a region of the pump chamber 12 in which the filling piece 30 is located and in which, downstream of the filling piece, the two gearwheels gradually engage increasingly further in one another, and the low-pressure side S of the pump. For good axial sealing off, there is arranged between the gearwheels 20 and 21 and each cover part 13 or 14 an axial sealing disk 45 which is pressed with some excess of force axially against the gearwheels 20 and 21 by a pressure which prevails in a pressure field 46 existing between said axial sealing disk and the corresponding cover part 13 or 14. Each axial sealing disk 45 closely surrounds the drive shaft 19 and the stop pin 34 and is thereby secured in its position in a plane perpendicular to the axis of the drive shaft 19. A pressure field 46 is formed by a clearance in the cover part 13 or 14. As may be gathered from the broken line in FIG. 2, said pressure field has a semicrescent-shaped form and extends approximately from the foot of the filling piece 30 at the stop pin 34 near to the mid-plane 22.

As is apparent from FIG. 2, an axial sealing disk 45 covers essentially only the high-pressure side of the pump, whilst the low-pressure side is kept free, so that friction, which would lower the efficiency of the pump, cannot take place there between the gearwheels and the axial sealing disk.

A suction duct 48 and a delivery duct 49 open into the pump chamber 12 at diametrically opposite points, the diameter of the suction duct 48 being larger than the diameter of the delivery duct 49. The ring wheel 21 possesses, in the tooth spaces, bores 50 which run continuously radially from the inside outward and through which a hydraulic fluid can pass from the suction duct 48 into the free space 23 and from there into the delivery duct 49.

The pump shown is designed in such a way that, during operation, the pinion 20 must be driven clockwise, as seen in FIG. 2. The ring wheel 21, too, then rotates clockwise. Hydraulic fluid located in the tooth spaces travels, together with the tooth spaces, along the filling piece 30 and passes into the tooth engagement region of the two gearwheels. There, the hydraulic fluid is displaced through the bores 50 of the ring wheel 21 into the delivery duct 49. Hydraulic fluid is simultaneously sucked out of the suction duct 48 into the free space 23 through other bores 50 and beyond the end faces of the gearwheels.

The gearwheels of the pump shown are hardened, so that, in particular, the teeth do not become worn and high volumetric efficiency is achieved. So that, during operation, the wear on the components serving for sealing off between the high-pressure region P and the low-pressure region S, specifically the sealing segment 31, the segment carrier 32 and the axial sealing disks 45, also remains low and particles do not enter the hydraulic fluid circuit which could block the throughflow orifices of small cross section or infiltrate into narrow guide gaps and lead to sluggishness or failure of the parts guided one against the other, said components are hardened on their surface. They consist of a sintered material, the initial mixture of which contains 15% to 25% copper, 2.5% to 3% molybdenum disulfide, about 0.4% graphite and the remainder iron in the form of ferrite. The latter is the constituent which may be hardened. This is carried out primarily by gas nitriding, which is a generally known method. The other constituents of the initial mixture for sintering serve for improving the sliding properties of the finished components, as compared with a pure ferrite mixture. After sintering and gas nitriding, the components are also ground and are thereby matched very accurately to the shape of the counterfaces on the gearwheels. The components, namely the sealing segment, segment carrier and axial sealing disks, therefore also tolerate faulty lubrication, which may occur particularly at high pressures, high rotational speeds or high temperatures of the hydraulic fluid, without any appreciable abrasion.

Figure 3:
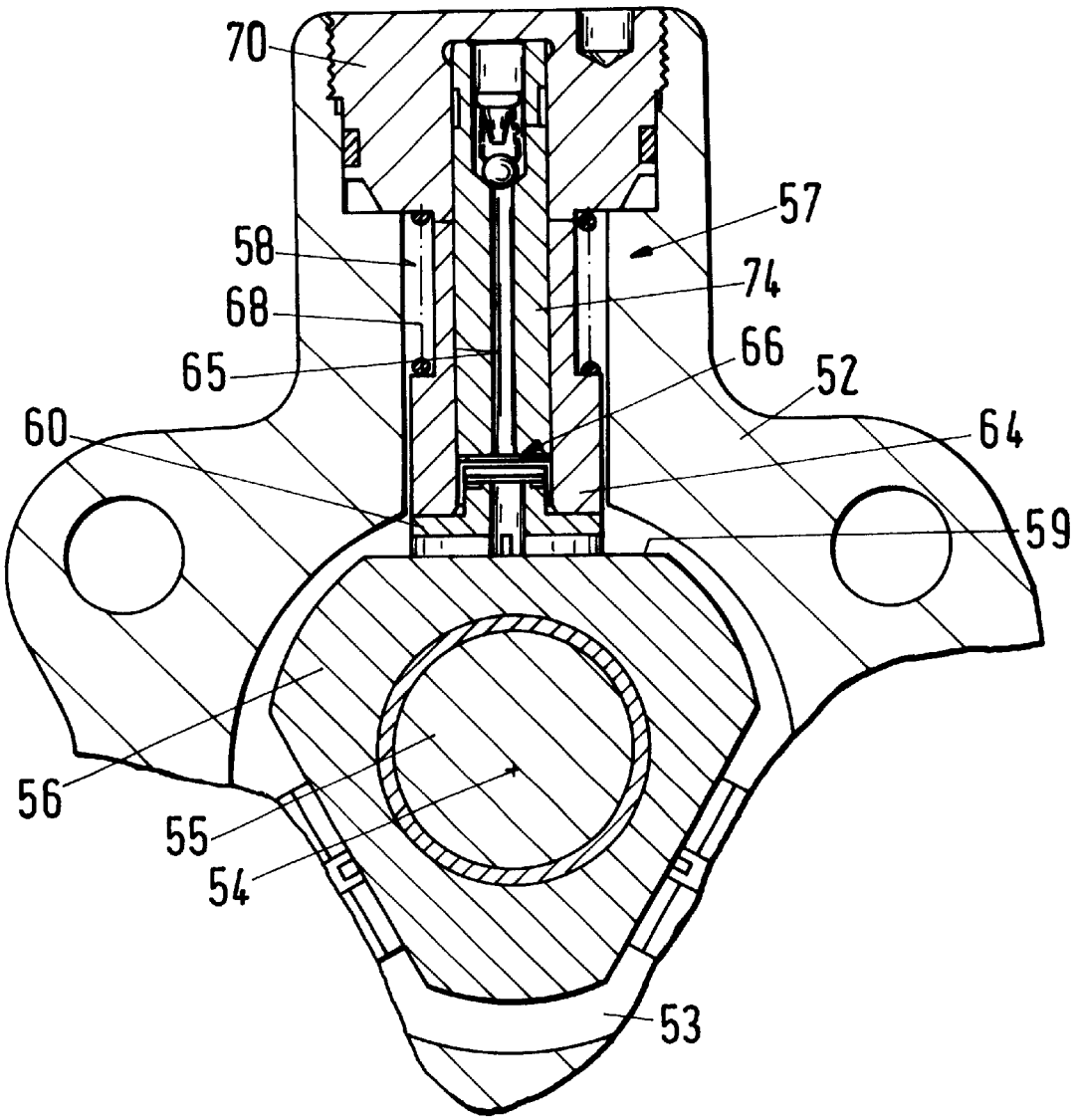
FIG. 3 shows the second exemplary embodiment in a section vertically through the drive shaft.

The radial piston pump according to FIG. 3, which is intended for feeding fuel in an automobile, possesses a pump casing 52, in which is arranged a central reception space 53 for receiving an eccentric pin 55 which is driven by a drive shaft, not illustrated in any more detail, with an axis 54 and on which an eccentric ring 56 is mounted rotatably. The latter is assigned, uniformly distributed about the axis 54, three displacement units 57, each of which is located in a radial bore 58 of the pump casing 52. The eccentric ring 56 is provided, corresponding to the three displacement units 57, with three flattenings 59 which are distributed on the circumference and on each of which is supported a sliding shoe 60 of a displacement unit 57. By means of the sliding shoes 60 resting under the effect of force on the flattenings 59, the eccentric ring 56 is retained in such a way that it cannot freely follow the rotational movement of the eccentric pin 55, but, instead, whilst preserving its orientation, is moved on a circle, that is to say executes a translational circular movement. During operation, therefore, the sliding shoes 60 slide back and forth on the flattenings 59.

Each displacement unit 57 includes a cylinder 64 with a cylinder bore 65, into which a sliding shoe 60 is pressed in abutment. Through each sliding shoe pass ducts which make it possible to fill the cylinder bore 65 via a suction valve 66 from the reception space 53. The cylinder 64 is prestressed in the direction of the flattening 59 via a compression spring 68, the compression spring being supported, on the one hand, on an outer shoulder of the cylinder 64 and, on the other hand, on a screw plug 70 which closes a radial bore 58.

Pressed into a central blind bore of the screw plug 70 is the end portion of a piston 74 which, projecting far beyond the screw plug 70, penetrates into the cylinder bore 65 and, together with the cylinder 64 and the sliding shoe 60, delimits a working space of variable volume.

The cylinder 64 executes a radial lifting movement during operation. Thus, during operation, a relative sliding movement between the cylinder 64 and the piston 74 takes place in addition to the relative sliding movement between the sliding shoe 60 and the eccentric ring 56.

So that the wear caused by the sliding movements on the components resting against one another remains low, in each case at least one of these components is produced from a sintered material which contains predominantly ferrite and, in addition, a constituent for improving the sliding properties and which is hardened at least on its surface. Thus, for example, the cylinder 64 could consist of a sintered material which is offered on the market under the name Ferromoliporit and which contains special lubricant deposits and is hardenable. There is no need for complicated surface treatment of the piston 74, by means of which attempts have been made hitherto to overcome the problems of wear. Instead of the cylinder 64, the piston 74 or cylinder and piston could also consist of the sintered material.

In the same way as one of the displacement parts, at least one of the parts sliding shoe and eccentric ring, in particular the eccentric ring, is also manufactured from said sintered material and hardened at least on its surface.

Ferromoliporit is the sintered material which, as described with reference to FIGS. 1 and 2, is also used for parts of the internal gear pump shown there. Accordingly, the initial mixture for this material is composed of 15% to 25% copper, 2.5% to 3% molybdenum disulfide, about 0.4% graphite and the remainder iron in the form of ferrite.

The specification incorporates by reference the disclosure of German priority document 199 58 483.0 of Dec. 18, 1998. The present invention is, of course, in no way restricted to the specific disclosure of the specification and drawings, but also encompasses any modifications within the scope of the appended claims.

What we claim is:

1. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having tooth tips; and a ring wheel meshing with said pinion and having tooth tips, said two components being disposed in said casing for sealing off a high-pressure region from a low-pressure region of said casing along said tooth tips of said pinion and said ring wheel, and said casing, said pinion and said ring wheel defining an internal gear machine including an internal gear pump;

wherein said sintered material contains preferably 15% to 25% copper.

2. The hydraulic displacement machine according to claim 1, where said at least one of said two components formed of said sintered material is hardened by nitriding.

3. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having tooth tips; and a ring wheel meshing with said pinion and having tooth tips, said two components being disposed in said casing for sealing off a high-pressure region from a low-pressure region of said casing along said tooth tips of said pinion and said ring wheel, and said casing, said pinion and said ring wheel defining an internal gear machine including an internal gear pump;

wherein said sintered material contains 2.5% to 3% molybdenum disulfide.

4. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having tooth tips; and a ring wheel meshing with said pinion and having tooth tips, said two components being disposed in said casing for sealing off a high-pressure region from a low-pressure region of said casing along said tooth tips of said pinion and said ring wheel, and said casing, said pinion and said ring wheel defining an internal gear machine including an internal gear pump;

wherein said sintered material contains 0.4% graphite.

5. A piston machine, comprising:

two displacement components slidably movable relative to one another and including a piston and a cylinder receiving said piston; and a lifting element having a surface on which one of said two displacement components slide and said lifting element selected from the group consisting of an eccentric ring and a lifting disk, and one of said two displacement components having a surface sliding on said lifting element being hardened at least on said surface sliding on said lifting element and said one of said two displacement components formed at least on said surface of a sintered material formed predominantly of a ferrite and a constituent for improving the sliding properties.

6. An internal gear pump, comprising:

a casing;

an externally toothed pinion disposed in said casing and having one of tooth tips and end faces;

a ring wheel meshing with said pinion and having one of tooth tips and end faces; and a component having a surface disposed in said casing for sealing off a high-pressure region from a low-pressure region of said casing along one of said tooth tips and said end faces of said pinion and said ring wheel, said component formed at least on said surface of a sintered material containing predominantly a ferrite and a constituent for improving the sliding properties.

7. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having end faces; and a ring wheel meshing with said pinion and having end faces, said two components being disposed in said casing for sealing off a high-pressure region from a low-pressure region of said casing along said end faces of said pinion and said ring wheel, and said casing, said pinion and said ring wheel defining an internal gear machine including an internal gear pump;

wherein said sintered material contains preferably 15% to 25% copper.

8. The hydraulic displacement machine according to claim 7, wherein said at least one of said two components formed of said sintered material is hardened by. nitriding.

9. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having end faces; and a ring wheel meshing with said pinion and having end faces, said two components being disposed in said casing for sealing off a high-pressure region from a low-pressure region of said casing along said end faces of said pinion and said ring wheel, and said casing, said pinion and said ring wheel defining an internal gear machine including an internal gear pump;

wherein said sintered material contains 2.5% to 3% molybdenum disulfide.

10. A hydraulic displacement machine including a hydraulic displacement pump, comprising:

two components slidably movable relative to one another and each having a surface, at least one of said two components being hardened at least on said surface and formed of a sintered material containing predominantly ferrite and a constituent for improving sliding properties;

a casing;

an externally toothed pinion disposed in said casing and having end faces; and a ring wheel meshing with said pinion and having end faces, said two components being disposed in said casing for sealing off a high-pressure region from a low-pressure region of said casing along said end faces of said pinion and said ring wheel, and said casing, said pinion and said ring wheel defining an internal gear machine including an internal gear pump;

wherein said sintered material contains 0.4% graphite.

11. A hydraulic displacement machine, including a hydraulic displacement pump, comprising:

two components slidably movable relative to one another and each having a surface, at least one of said two components being hardened at least on said surface and formed of a sintered material containing predominantly ferrite and a constituent for improving sliding properties, wherein said two components are a piston and a cylinder receiving said piston; and a lifting element having a surface on which one of said two components slides, wherein said lifting element is selected from the group consisting of an eccentric ring and a lifting disk, and wherein said lifting element is hardened at least on said surface and is formed of said sintered material containing predominantly said ferrite and said constituent for improving the sliding properties, and said piston, said cylinder and said lifting element define a piston machine.

12. The hydraulic displacement machine according to claim 11, wherein said eccentric ring has a plurality of flattenings, and on each of said flattenings at least one of said two components slides.

13. The hydraulic displacement machine according to claim 11, wherein said at least one of said two components formed of said sintered material is hardened by nitriding.

14. The hydraulic displacement machine according to claim 11, wherein said sintered material contains preferably 15% to 25% copper.

15. The hydraulic displacement machine according to claim 11, wherein said sintered material contains 2.5% to 3% molybdenum disulfide.

16. The hydraulic displacement machine according to claim 11, wherein said sintered material contains 0.4% graphite.

* * * * *